US006382998B2

(12) United States Patent
Miwa

(10) Patent No.: US 6,382,998 B2
(45) Date of Patent: May 7, 2002

(54) CONNECTOR ASSEMBLY WITH A CONTACT PROTECTION FUNCTION

(75) Inventor: Takeya Miwa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/796,603

(22) Filed: Mar. 2, 2001

(30) Foreign Application Priority Data

Mar. 2, 2000 (JP) ..... 2000-056960
Mar. 2, 2000 (JP) ..... 2000-057288

(51) Int. Cl.[7] ..... H01R 13/53
(52) U.S. Cl. ..... 439/181
(58) Field of Search ..... 439/181, 924.1, 439/188, 183

(56) References Cited

U.S. PATENT DOCUMENTS 5,066,240 A * 11/1991 Verdun ..... 439/181
5,176,528 A * 1/1993 Fry et al. ..... 439/181
5,356,300 A 10/1994 Costello et al. ..... 439/101

FOREIGN PATENT DOCUMENTS

EP 0717469 A2 6/1996

* cited by examiner

*Primary Examiner*—Tho D. Ta
*Assistant Examiner*—Ann M McCamey
(74) *Attorney, Agent, or Firm*—Finnegan, Henderson, Farabow, Garrett, & Dunner, L.L.P.

(57) ABSTRACT

A dummy tab is detachably held in a female connector housing. A dummy spring is detachably held in a male connector housing. When a male and female connection terminals are connected, the dummy tab comes into contact with the dummy spring before a contact protrusion comes into contact with a contact spring. This arrangement generates an arc discharge in the contact between the dummy tab and the dummy spring before the contact protrusion comes into contact with the contact spring, thereby to protect the female and male connection terminals as original contacts from deterioration or damage under an arc discharge.

15 Claims, 7 Drawing Sheets

CONNECTOR ASSEMBLY WITH A CONTACT PROTECTION FUNCTION

BACKGROUND OF THE INVENTION

1. Field of the Invention

The present invention relates to a connector assembly with a contact protection function.

2. Description of the Related Art

A connector assembly has a female connector and a male connector mated with each other for connection. The female connector has a female connector housing in which a male connection terminal is accommodated and fixed. The male terminal is disposed to protrude at its front part into a hood of the female connector housing.

The male connector has a male connector housing in which a female connection terminal is accommodated and fixed. The female terminal has a tubular front end into which the front part of the male terminal is to be inserted. At the front end of the female terminal, a contact spring is formed, being folded back obliquely into the tubular space.

In the connector of this structure, when the female connector is mated with the male connector, the front part of the male connection terminal is inserted into the female connection terminal from its front end to contact the spring, thereby to establish conduction.

However in the above connector assembly, when the female connector is mated with the male connector in a conducting state, the front part of the male terminal first comes into contact with the front end of the female terminal, which causes to generate an arc discharge at the contacts to deteriorate or damage the contacts. Further, when the connectors are disengaged, the front end of the male terminal is last disengaged from the front end of the male terminal, which also causes to generate an arc discharge at the corresponding parts to deteriorate or damage the contacts.

The deterioration of or damage to the contacts prevents the contacts of the female and male terminals from establishing good conduction, which causes to deteriorate the connector in reliability.

SUMMARY OF THE INVENTION

The present invention has been achieved with such points in view.

It is therefore an object of the present invention to provide a connector assembly provided with connection terminals, the connector assembly having a contact protection function, in which the deterioration of or damage to front parts of the terminals to be connected to each other can be prevented to protect the front parts of the terminals.

According to a first aspect of the invention, there is provided a connector assembly including first and second housings to be mated with each other, first and second terminals held in the first and second housings, respectively, the terminals being configured to be brought into contact with each other to establish a conduction as the housings are mated, and first and second discharge members provided in the first and second housings, respectively. The discharge members are brought into contact with each other before the terminals contact with each other as the housings are mated, and the discharge members are disengaged from each other after the terminals are disengaged as the housings are disengaged.

Thus in this invention, an arc discharge is prevented from adversely affecting the contacts even if an arc discharge is generated between the discharge members. Also when the terminals are disengaged from each other, the discharge members are disengaged after the disengagement of the terminals. This eliminates the generation of an arc discharge at the terminals, preventing an arc discharge from adversely affecting the contacts of the terminals. As a result, the terminals are free from deterioration or damage under an arc discharge, which improves the reliability of the connector.

According to a second aspect of the invention, the first and second discharge members are brought in contact with side surfaces of the first and second terminals under pressure, respectively.

Thus in this invention, the discharge members are conducted to the terminals. This has an effect of generating an arc discharge between the discharge members which come into contact with each other before the terminals do and preventing the generation of an arc discharge between the terminals when the housings are mated to make the terminals contact with each other.

According to a third aspect of the invention, respective one of the discharge members has curved parts, the curved parts being brought in contact with the side surfaces of the terminals.

According to a fourth aspect of the invention, the first and second discharge members are each detachably held in the first and second housings, respectively.

Thus in this invention, the discharge members can be replaced easily.

According to a fifth aspect of the invention, respective one of the first terminal and the first discharge member has respective one of contact protrusions, the contact protrusions extending in the first housing at substantially the identical length, and the front end of the second discharge member is displaced from the front end of the second terminal in the mating direction.

According to a sixth aspect of the invention, respective one of the first terminal and the first discharge member has respective one of contact protrusions, a contact protrusion of the first discharge member is protruded farther than a protrusion of the first terminal, and the front ends of the second discharge member and the second terminal are set at substantially the identical position in the mating direction.

According to a seventh aspect of the invention, one of the first and the second discharge members is connected to a wire for discharge.

According to an eighth aspect of the invention, the wire passes through a housing for holding the one of the first and the second discharge members.

According to a ninth aspect of the invention, one of the first and second housings includes a guide for disconnection of a discharge member from a terminal in the other one of the first and second housings.

Thus in this invention, with mate of the pair of housing, after the terminals are contacted with each other, the guide in the one housing makes the discharge member disconnected from the terminal for break. As a result, this eliminates unnecessary contact from the terminal in the other connector housing, and the connector assembly is improved in reliability.

According to a tenth aspect of the invention, a first connector having a first housing, a second connector having a second housing to be mated with the first housing, a first terminal held in the first housing, the first terminal having a first contact, a second terminal held in the second housing, the second terminal having a second contact to be brought into contact with the first contact, a first discharge member held in the first housing and being brought in contact with the first terminal under pressure, the first discharge member having a third contact which is displaced. at a first displacement S1 from the first contact, and a second discharge member held in the second housing and being brought in contact with the second terminal under pressure, the second discharge member having a fourth contact to be brought into contact with the third contact, the fourth contact being displaced at a second displacement S2 from the second contact, wherein, a relationship between the first displacement S1 and the second displacement S2 is that S1+S2>0.

BRIEF DESCRIPTION OF THE ACCOMPANYING DRAWINGS

The above and further objects and novel features of the invention will more fully appear from the following detailed description when the same is read in conjunction with the accompanying drawings, in which.

DETAILED DESCRIPTION OF THE PREFERRED EMBODIMENTS

With reference to the accompanying drawings, preferred embodiments of this invention will now be described.

First Embodiment

Figure 1:
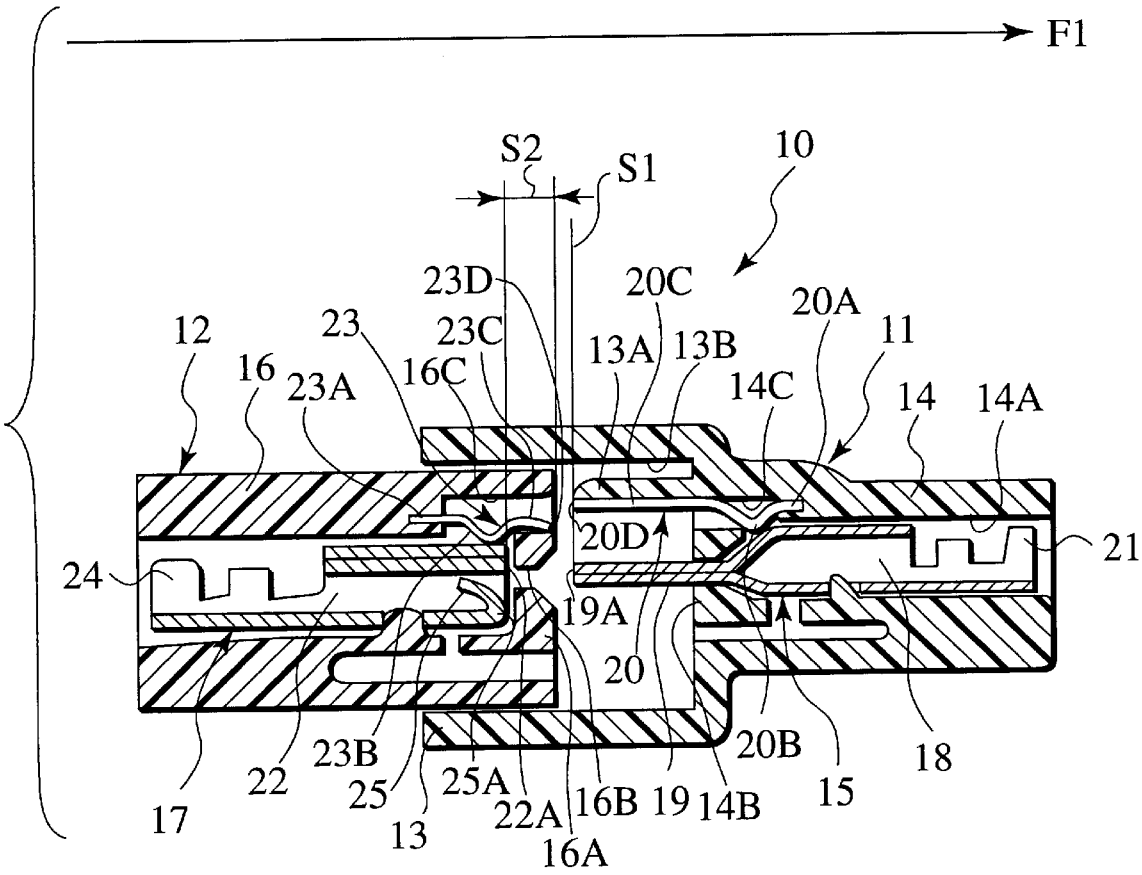
FIG. 1 is a sectional view showing a connector according to a first embodiment of this invention, in which the connector is in the middle of engagement or disengagement.

FIG. 1 shows a connector 10 including a female connector 11 as a first connector and a male connector 12 as a second connector. The female connector 11 has a female connector housing 14 with a fit-in hood 13 at its front side, in which a male connection terminal 15 as a first connection terminal is disposed to be held. In the female housing 14, a dummy tab 20 has a dummy contact (a first discharge member) abutting on a side surface of the male terminal 15 is detachably held. The male connector 12 has a male connector housing 16 to be fitted into the hood 13 of the female housing 14 at its front end, in which housing 16 a female connection terminal 17 as a second connection terminal is disposed to be held. In the male housing 16, a dummy spring 23 has a dummy contact (a second discharge member) abutting on a side surface of the female terminal 17 is detachably held.

The male terminal 15, as shown in FIG. 1, includes a male terminal body 18 supported in the female housing 14 and a contact protrusion 19 provided at the front end of the male terminal body 18. At the rear of the male terminal body 18, a plurality of pairs of wire holding pieces 21 for holding a wire not shown in the figure is formed.

The female housing 14 holding the male terminal 15 of this structure includes a terminal accommodating space 14A in which the male terminal body 18 of the male terminal 15 is held. The protrusion 19 of the male terminal 15 passes through an intermediate wall 14B which makes a distinction between the accommodating space 14A and the space in the hood 13, to protrude into the hood 13.

Figure 4:
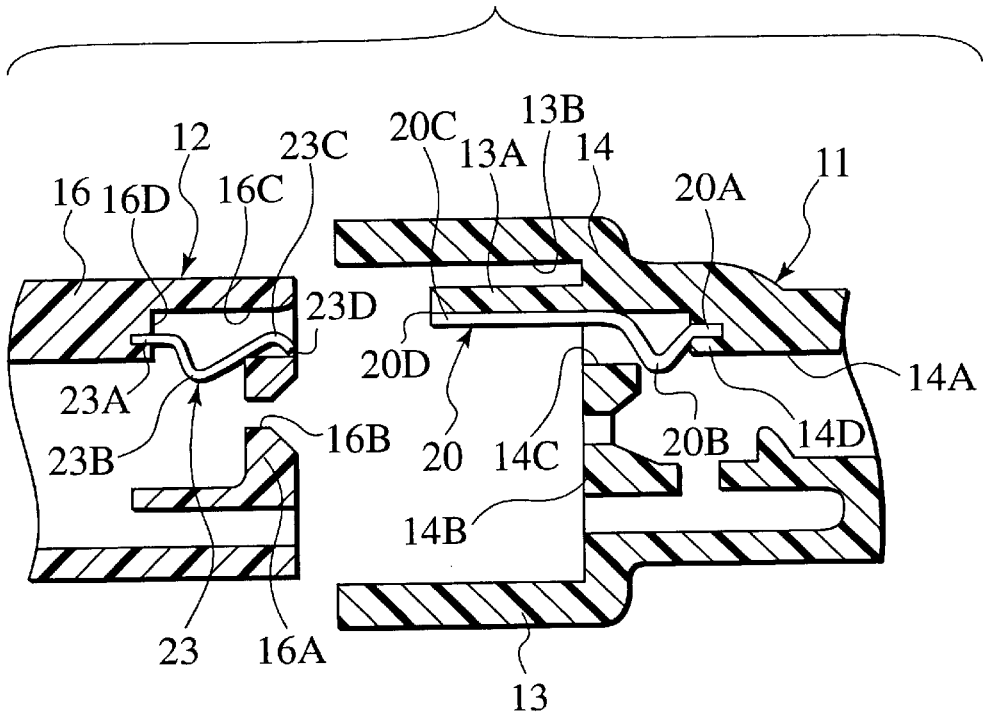
FIG. 4 is a sectional view showing the connector according to the embodiment before terminals are fitted therein.

The dummy tab 20 is, as shown in FIG. 4, inserted from a tab insertion hole 14C formed in the intermediate wall 14B of the female housing 14 to be embedded in a peripheral wall 14D of the accommodating space 14A. The dummy tab 20 protrudes into the hood 13 from the tab insertion hole 14C. In the hood 13, a tab holding wall 13A for holding the dummy tab 20 along an outer surface of the dummy tab 20 is formed. Between the holding wall 13A and the hood 13, an insertion space 13B for receiving a front part of the male housing 16 of the male connector 12 is provided.

Figure 2:
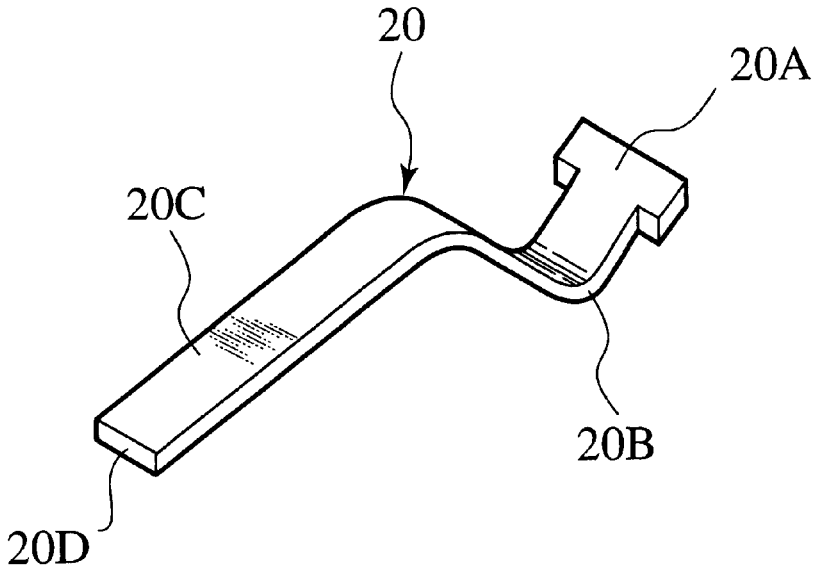
FIG. 2 is a perspective view showing a dummy tab used in the embodiment.

The dummy tab 20 includes, as shown in FIG. 2, a mounting part 20A to be detachably held in the peripheral wall 14D of the female housing 14, a contact curve 20B to abut on a side surface of the male terminal 15 and a contact plate 20C to come into contact with the dummy spring 23.

The male housing 16 has, as shown in FIGS. 1 and 4, a front wall 16A at its front end, and holds the female terminal 17 inserted from the rear side thereof. The front wall 16A is provided in its central part with a protrusion guiding hole 16B through the wall in the transverse direction. The front wall 16A is also provided with a tab insertion hole 16C for receiving the holding wall 13A and the dummy tab 20 held by the wall 13A. The insertion hole 16C has a peripheral wall 16D at the inner back thereof, in which the dummy spring 23 is inserted to be embedded. The dummy spring 23 is detachably held in the peripheral wall 16D.

Figure 3:
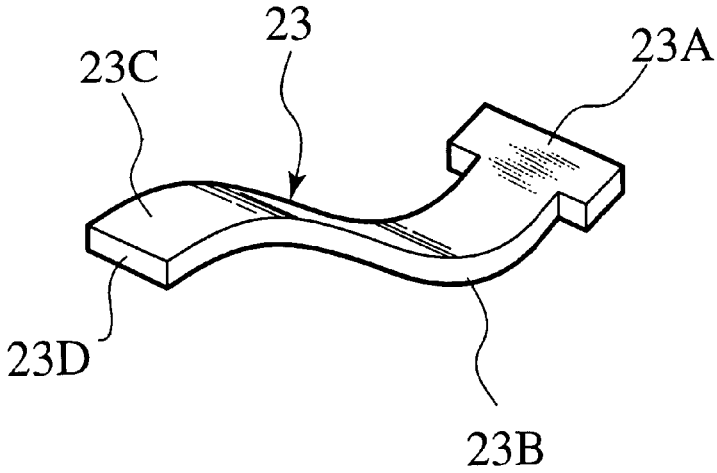
FIG. 3 is a perspective view showing a dummy spring used in the embodiment.

FIG. 3 shows the dummy spring 23 which includes a mounting part 23A to be inserted and held in the peripheral wall 16D of the male housing 16, a contact curve 23B to abut on a side surface of the female terminal 17 and a contact plate 23C to come into contact with the contact plate 20C of the dummy tab 20 inserted into the insertion hole 16C.

The female terminal 17 held in this male connector housing 16 includes a female terminal body 22 in a substantially rectangularly tubular shape to be held in the male housing 16 and a plurality of pairs of wire holding pieces 24 formed at the rear part of the terminal body 22 as shown in FIG. 1. At the rim of the front end opening of the female terminal body 22, a contact spring 25 as a contact folded back inside is formed. When the female and male connectors 11 and 12 are mated with each other, the contact spring 25 comes into contact with the protrusion 19.

The dummy spring 23 and the dummy tab 20 are set to come into contact with each other before the contact protrusion 19 and the contact spring 25 do during the mating of the female and male connectors 11 and 12. Specifically, as shown in FIG. 1, the dummy tab 20 protrudes into the hood 13 almost as long as the protrusion 19 does, and the dummy spring 23 is disposed to extend in the mating direction beyond the front end of the female terminal 17, which arrangement makes the dummy tab 20 and the dummy spring 23 come into contact with each other before the contact protrusion 19 and the contact spring 25 do during the mating of the female and male connectors 11 and 12.

The distal end 19A of protrusion 19 first contacts with the proximal end 25A of contact spring 25 or the distal end 22A of female terminal body 22 in dependence on a bent state of the spring 25. The end 20D of tab 20 first contacts with the distal end 23D of spring 23.

In a mating direction F1 on FIG. 1, the distal end 20D of the tab 20 is displaced from the distal end 19A at a displacement S1 of substantially zero. If the distal end 20D is positioned at an opposite side to the male terminal body 18 relative to the end 19A, the displacement S1 is positive. If the end 20D is positioned at an identical side with the male terminal body 18 relative to the distal end 19A, the displacement S1 is negative.

On the other hand, in the mating direction F1, the distal end 23D of spring 23 is displaced from the proximal end 25A at a positive displacement S2. If the end 23D is positioned at an opposite side to the female terminal body 22 relative to the proximal end 25A, the displacement S1 is positive. If the distal end 23D is positioned at an identical side with the female terminal body 22 relative to the proximal end 25A, the displacement S2 is negative.

The embodiment requires that a relationship between S1 and S2 is S1+S2>0. If the relationship between them is S1 +S2<0, the end 19A contacts with the end 25*a* earlier or at an identical time.

In the connector 10 of this structure, when the female connector 11 is mated with the male connector 12, the contact protrusion 19 protruded into the hood 13 of the female connector housing 14 is inserted through the guiding hole 16B in the front wall 16A of the male connector housing 16. Since the dummy spring 23 is formed to protrude farther than the front end of the female terminal body 22, it then comes into contact with the dummy tab 20 before the protrusion 19 and the spring 25 do. At this time, an arc discharge is generated between the dummy spring 23 and the dummy tab 20. This prevents the generation of an arc discharge in the contact between the protrusion 19 as the original contact and the spring 25, protecting the protrusion 19 and the spring 25 from deterioration or damage under an arc discharge.

The dummy spring 23 and the dummy tab 20 are subjected to an arc discharge and thus to be deteriorated or damaged. However, there occurs no problem because they are not original contacts. The dummy tab 20 and the dummy spring 23 are detachably held in the female housing 14 and the male housing, respectively, and therefore can be replaced when deteriorated or damaged to an unacceptable level.

In this embodiment, since the dummy tab 20 and the dummy spring 23 as dummy contacts are detachably held in the female and male housings 14 and 16, just fitting the dummy tab 20 and the dummy spring 23 into the housings can provide a connector having a contact protection structure. This improves the connector 10 in durability and reliability.

Figure 5:
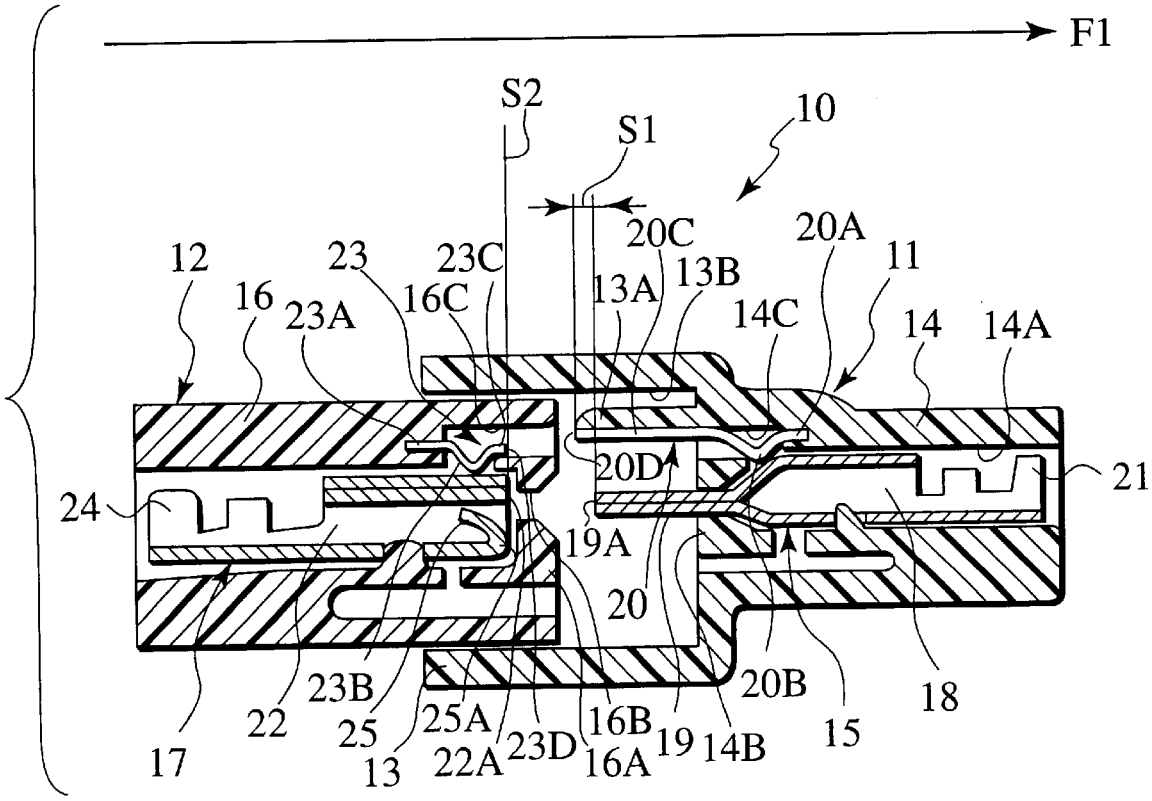
FIG. 5 is a sectional view showing a connector according to another embodiment of this invention.
Figure 6:
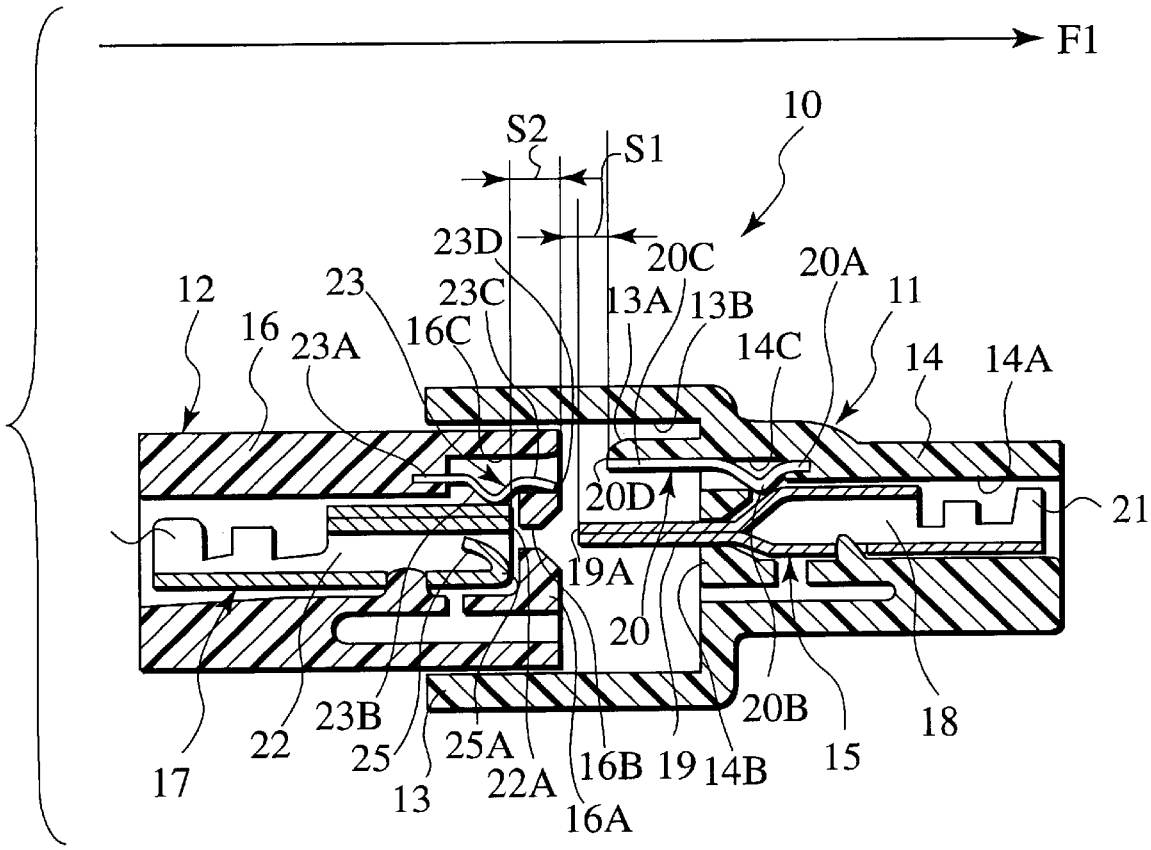
FIG. 6 is a sectional view showing a connector according to further another embodiment of this invention.

The above description of the embodiment is not intended to limit the scope of the present invention. Variations and modifications are possible with respect to the structural elements. For example, in the above embodiment, the dummy spring 23 is formed to protrude farther than the front end 22A of the female terminal body 22. It is also possible as shown in FIG. 5 as another embodiment to set the front end of the dummy spring 23 at almost the same position in the mating direction as the front end of the female terminal body 22 and to set the dummy tab 20 protruding more than the distal end 19A of the contact protrusion 19, thereby to obtain the similar effects. In this case, the displacement S1 is positive, and the displacement S2 is substantially zero, so that the sum of the displacements S1 and S2 is positive. As shown on FIG. 6, the distal end 23D of the spring 23 may be displaced from the proximal end 25A on an opposite side to the female terminal body 22 and the end 20D of tab 20 may be displaced from the end 19A of protrusion 19 on an identical side with the male terminal body 18. The displacement S1 is negative and the displacement S2 is positive, so that this requires that the absolute value of S2 is greater than one of S1.

Second Embodiment

A connector 110 has a female connector 111 and a male connector 112. The female connector 111 has a female connector housing 114 with a fit-in hood 113 at its front end, in which a male connection terminal 115 as a first terminal is disposed to be held. In the female housing 114, an arc discharge spring 120 as a first discharge member abutting on a side surface of the male terminal 115 is fixed. The male connector 112 has a male connector housing 116 to be fitted into the hood 113 of the female housing 114 at its front end, in which housing 116 a female connection terminal 117 as a second terminal is disposed to be held. In the male housing 116 is held a dummy terminal 123 as a second discharge member at a side of the female connection terminal 117 with a wall 116E therebetween.

Figure 7:
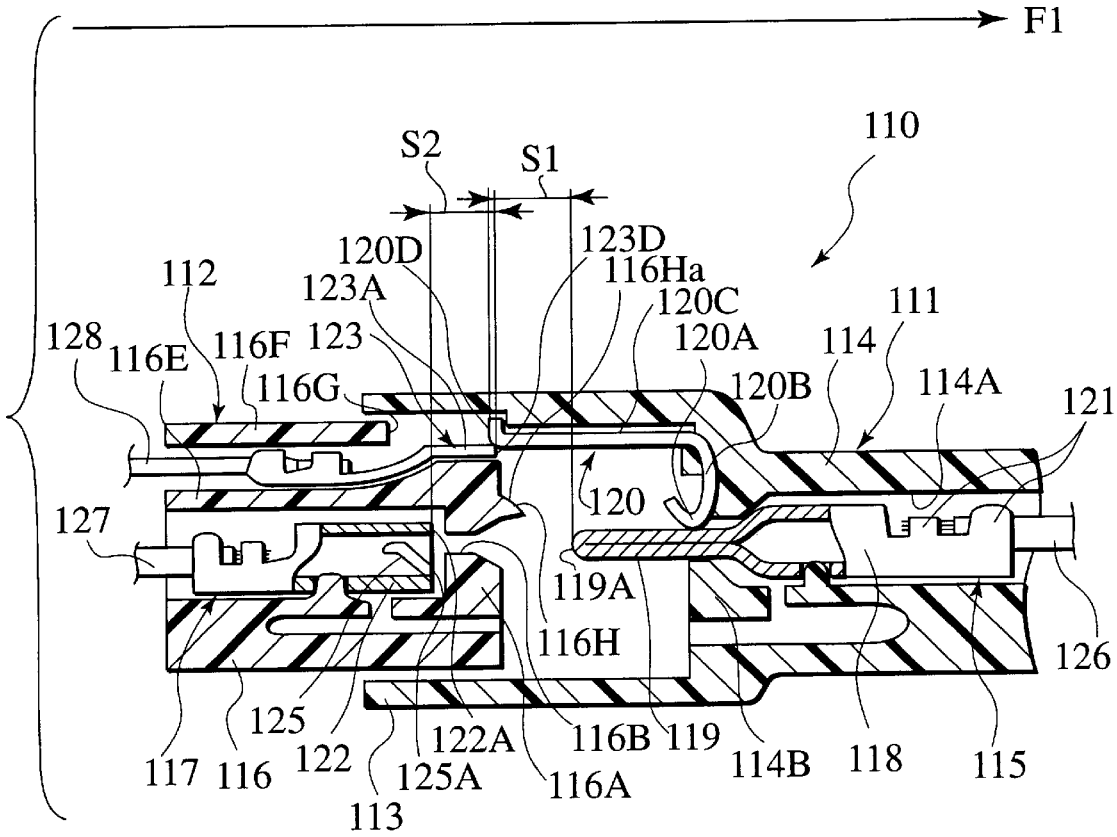
FIG. 7 is a sectional view showing a connector according to a second embodiment of this invention.

The male terminal 115, as shown in FIG. 7, includes a male terminal body 118 supported in the female housing 114 and a contact protrusion 119 provided at the front end of the male terminal body 118. At the rear of the male terminal body 118, a plurality of pairs of wire holding pieces 121 for holding a wire 126 is formed.

The female housing 114 holding the male terminal 115 of this structure includes a terminal accommodating space 114A in which the male terminal body 118 of the male terminal 115 is held. The protrusion 119 of the male terminal 115 passes through an intermediate wall 114B to protrude into the hood 113, the wall 114B defining the accommodating space 114A and the space in the hood 113.

The arc discharge spring 120 is, as shown in FIG. 7, arranged to be extended in the opening direction of the hood 113 along an internal bottom part and an internal side wall of the hood 113, and is fixed by insert molding.

Figure 8:
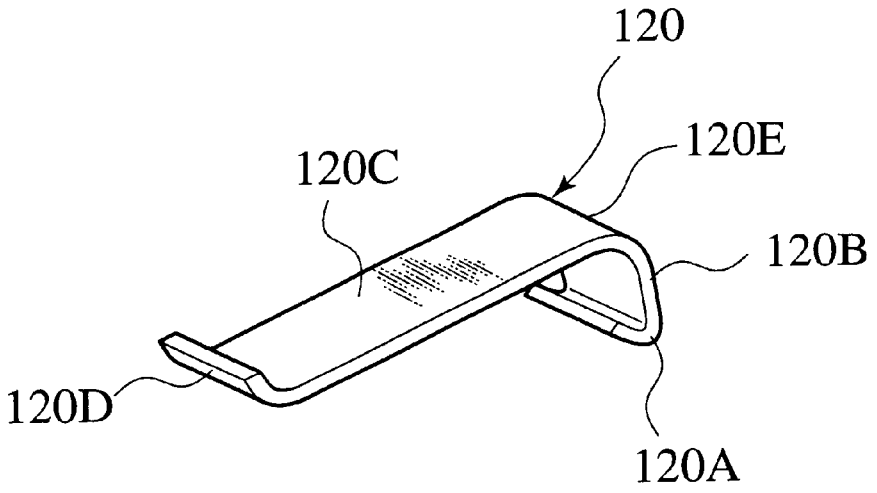
FIG. 8 is a perspective view showing an arc discharge spring used in the embodiment.

The arc discharge spring 120 includes a contact curve 120A configured to abut on a peripheral surface of the contact protrusion 119 of the male terminal 115, a fixed part 120B to be fixed on the internal bottom part of the hood 113 by insert molding and a contact plate 120C to be brought into contact with the dummy terminal 123 as shown in FIG. 8. A bend 120E bent at roughly a right angle is provided between the fixed part 120B and the contact plate 120C. At the tip of the contact plate 120C is formed a bend 120D as a contact for guiding a front part 123A of the dummy terminal 123.

The male housing 116 has, as shown in FIG. 7, a front wall 116A at its front end, and holds the female terminal 117 inserted from the rear end thereof. The front wall 116A is provided in its central part with a protrusion guiding hole 116B passing through the wall in the transverse direction. An outside wall 116F opposed to the wall 116E has a notch 116G formed on the periphery of the front wall 116A, at which notch 116G the front part 123A of the dummy terminal 123 is positioned. The dummy terminal 123 is disposed outside the wall 116E of the male housing 116.

On the periphery of the protrusion guiding hole 116B of the front wall 116A of the male housing 116 is provided a disengagement protrusion 116H to be interposed between the contact curve 120A of the discharge spring 120 and the contact protrusion 119 at the time of the mating so as to disengage the contact curve 120A and the contact protrusion 119 from each other.

Figure 9:
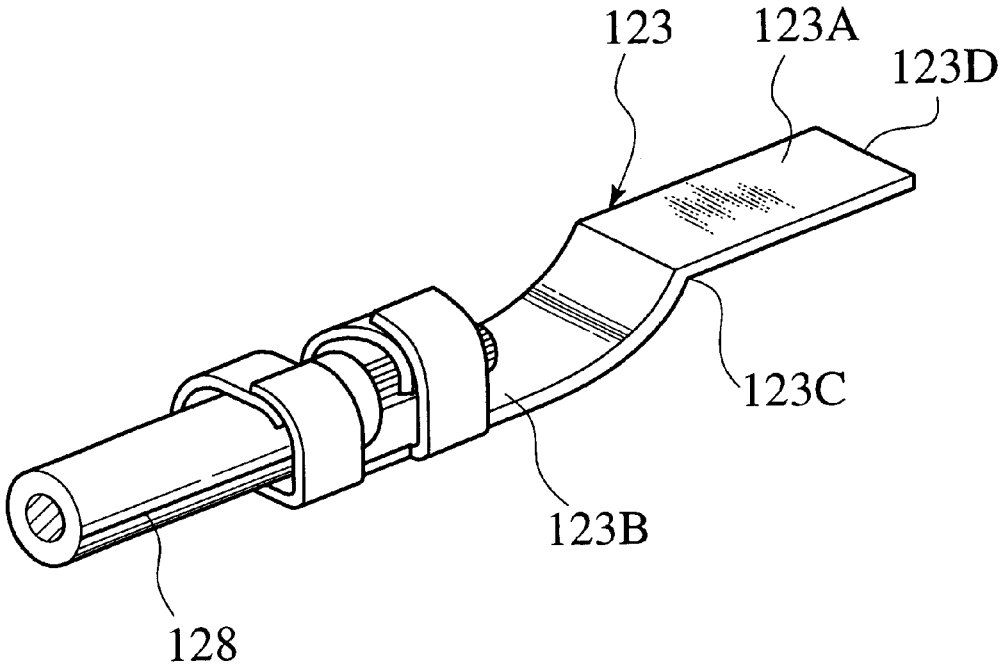
FIG. 9 is a perspective view showing a dummy tab used in the embodiment.

As shown in FIG. 9, the dummy terminal 123 includes a front part 123A to be brought into contact with the contact plate 120C of the arc discharge spring 120 and a wire holding part 123B. To the wire holding part 123B is connected and fixed a dummy wire 128. The front part 123A comes into contact with the bend 120D of the discharge spring 120 at its tip 123D first.

The female terminal 117 has a female terminal body 122. At the rim of the front end opening of the body 122 is formed a contact spring 125 as a contact folded back inside at a proximal end 125A. When the female and male connectors 111 and 112 are mated with each other, the spring 125 comes into contact with the protrusion 119.

The dummy terminal 123 and the arc discharge spring 120 are set to come into contact with each other before the contact protrusion 119 and the contact spring 125 do during the mating of the female and male connectors 111 and 112. Specifically, as shown in FIG. 7, the arc discharge spring 120 is protruded farther than the contact protrusion 119, and the dummy terminal 123 is also protruded farther than the front end of the female terminal 117, which arrangement makes them come into contact with each other before the contact protrusion 119 and the contact spring 125 do during the mating of the female and male connectors 111 and 112. At the time when the contact protrusion 119 and the contact spring 125 are fully brought into contact with each other, the contact curve 120A abutting on the contact protrusion 119 is disconnected from the disengagement protrusion 116H. That is, a guiding surface 116Ha of the protrusion 116H guides the curve 120A to be displaced away from the protrusion 119. This thus eliminates an unstable and unnecessary contact from the male terminal 115, thereby improving reliability in connection.

Conversely, when the female connector 111 and the male connector 112 are disengaged from each other, the dummy terminal 123 and the arc discharge spring 120 are disengaged after the disengagement (separation) of the contact protrusion 119 and the contact spring 125. At the time of the disengagement (separation) of the protrusion 119 and the spring 125, the disengagement protrusion 116H is detached from the contact curve 120A. Therefore the curve 120A again abuts on the protrusion 119, which prevents the generation of arc discharge between the protrusion 119 and the spring 125.

Figure 10:
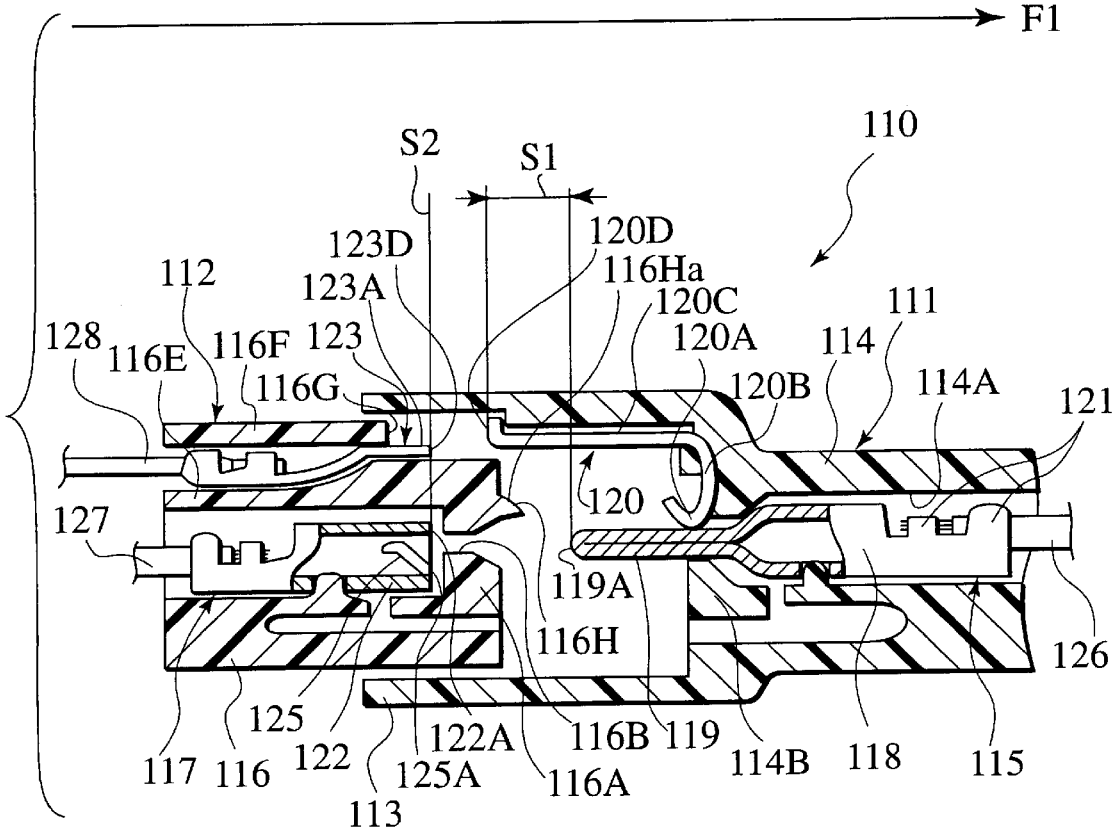
FIG. 10 is a sectional view of another embodiment relative to one in FIG. 7.

In a mating direction F1 in FIG. 10, the bend, or a distal end, 120D of the spring 120 is displaced from the distal end 119A at a positive displacement S1. If the distal end 120D is positioned at an opposite side to the male terminal body 118 relative to the end 119A, the displacement S1 is positive. If the end 120D is positioned at an identical side with the male terminal body 118 relative to the distal end 119A, the displacement S1 is negative.

On the other hand, in the mating direction F1, the distal end 123D of the terminal 123 is displaced from the proximal end 125A at a positive displacement S2. If the end 123D is positioned at an opposite side to the female terminal body 122 relative to the proximal end 125A, the displacement S1 is positive. If the distal end 123D is positioned at an identical side with the female terminal body 122 relative to the proximal end 125A, the displacement S2 is negative. The embodiment requires that a relationship between S1 and S2 is $S1+S2>0$. If the relationship between them is $S1+S2 \leqq 0$, the end 119A contacts with the end 125*a* earlier or at an identical time.

In the connector 110 of this structure, the engagement of the female connector 111 and the male connector 112 causes the contact protrusion 119 protruded in the hood 113 of the female housing 114 to be inserted through the protrusion guiding hole 116B of the front wall 116A of the male housing 116. At that time, the dummy terminal 123 is brought into contact with the discharge spring 120 before the contact between the protrusion 119 and the spring 125 is established.

Since an arc discharge is generated between the dummy terminal 123 and the discharge spring 120, no arc discharge is generated at the contact between the contact protrusion 119 and the contact spring 123 as original contacts, which protects the protrusion 119 and the spring 123 from deterioration or damage caused by an arc discharge. Although the dummy terminal 123 and the discharge spring 120 are subjected to deterioration or damage caused by an arc discharge, there occurs no problem because they are not original contacts.

In this embodiment, the arc discharge spring 120 and the dummy terminal 123 provided in the female and male housings 114 and 116, respectively, bring about a connector with a contact protection structure. This improves the durability and reliability of the connector 110.

The above description of the embodiment is not intended to limit the scope of the present invention. Variations and modifications are possible with respect to the structural elements. For example, although the dummy terminal 123 is protruded farther than the front end of the female terminal body 122 in the above embodiment, it is also possible to set the dummy terminal 123 at a substantially identical position with the front end of the female terminal body 122 and set the discharge spring 120 protruded farther than the contact protrusion 119 as shown in FIG. 10.

Further, although the discharge spring 120 is insert-molded in the female housing 114 in the above embodiment, it is also proper to fix it with some other fixing means.

The above description has shown the effects of preventing an arc discharge from adversely affecting the contacts even when an arc discharge is generated between the dummy contacts. When the connection terminals are disconnected, the dummy contacts are disengaged before the terminals are disengaged, thereby to eliminate the generation of an arc discharge between the terminals, which prevents an arc discharge from adversely affecting the contacts of the terminals. This has an effect of eliminating the generation of deterioration of or damage to the terminals under an arc discharge so as to improve the connector in reliability.

When the pair of connector housings are mated to make the connection terminals contact each other, an arc discharge is generated between the dummy contacts that come into contact with each other before the terminals do, which has an effect of eliminating the generation of an arc discharge between the terminals.

The dummy contacts are detachably mounted in the connector housings, and therefore can be easily replaced. This makes it possible to use the connector for an extended time by replacing the dummy contacts instead of replacing the connection terminals.

What is claimed is:

1. A connector assembly, comprising:

first and second housings configured to be mated with each other;

first and second terminals disposed in the first and second housings, respectively, the first and second terminals being configured to be brought into contact with each other; and first and second discharge members provided in the first and second housings, respectively, and disposed in contact with side surfaces of the first and second terminals, respectively, wherein, the discharge members are brought into contact with each other before the terminals contact with each other as the housings are mated; and the discharge members are disengaged from each other after the terminals are disengaged as the housings are disengaged.

2. A connector assembly as set forth in claim 1, wherein each of the first and second discharge members has at least one curved part, the curved part being in contact with a side surface of the respective first or second terminal.

3. A connector assembly as set forth in claim 1, wherein the first and second discharge members are detachably held in the first and second housings, respectively.

4. A connector assembly as set forth in claim 1, wherein:

the first terminal has a contact protrusion;

the first discharge member has a contact protrusion;

the second terminal has a front end; and the second discharge member has a front end, and wherein each of the contact protrusions of the first terminal and the first discharge member extends from the first housing in the mating direction at a substantially identical distance, and the front end of the second discharge member is located further from the second housing in the mating direction than the front end of the second terminal.

5. A connector assembly as set forth in claim 1, wherein:

the first terminal has a contact protrusion;

the first discharge member has a contact protrusion;

the second terminal has a front end; and the second discharge member has a front end, and wherein, the contact protrusion of the first discharge member extends further from the first housing in the mating direction than the contact protrusion of the first terminal, and the front end of the second terminal and the front end of the second discharge member are located at a substantially identical distance from the second housing in the mating direction.

6. A connector assembly as set forth in claim 1, wherein one of the first and second housings includes a guide for disconnecting the discharge member from the terminal in the other one of the first and second housings.

7. A connector assembly as set forth in claim 1, wherein one of the first and the second discharge members is connected to a wire for discharge.

8. A connector assembly as set forth in claim 7, wherein the wire passes through a housing for holding the one of the first and the second discharge members.

9. A connector assembly, comprising:

a first connector having a first housing;

a second connector having a second housing to be mated with the first housing;

a first terminal held in the first housing, the first terminal having a first contact;

a second terminal held in the second housing, the second terminal having a second contact to be brought into contact with the first contact;

a first discharge member held in the first housing and being brought in contact with the first terminal under pressure, the first discharge member having a third contact which is displaced at a first displacement (S1) from the first contact; and a second discharge member held in the second housing and being in contact with the second terminal under pressure, the second discharge member having a fourth contact to be brought into contact with the third contact, the fourth contact being displaced at a second displacement (S2) from the second contact;

wherein, a relationship between the first displacement S1 and the second displacement (S2) is that the first displacement (S1)+the second displacement S2>0.

10. A connector assembly, comprising:

a first housing and a second housing configured to be mated with each other;

a first terminal disposed in the first housing, a second terminal disposed in the second housing, the first and the second terminals being configured to be brought into contact with each other; and a first discharge member disposed in contact with the first terminal in the first housing, a second discharge member disposed in contact with the second terminal in the second housing, the first and the second discharge members being configured to be brought into contact with each other.

11. A connector assembly as set forth in claim 10, wherein at least one of the first and second discharge members has at least one curved part and the curved part is disposed in contact with a surface of the respective terminal.

12. A connector assembly as set forth in claim 10, wherein at least one of the first and second discharge members are detachably held in the first and second housings, respectively.

13. A connector assembly as set forth in claim 10, wherein one of the first and second housings includes a guide for disconnecting the discharge member from the terminal in the other one of the first and second housings.

14. A connector assembly as set forth in claim 10, wherein one of the first and the second discharge members is connected to a wire for discharge.

15. A connector assembly as set forth in claim 14, wherein the wire passes through a housing for holding the one of the first and the second discharge members.

* * * * *

UNITED STATES PATENT AND TRADEMARK OFFICE

CERTIFICATE OF CORRECTION

PATENT NO. : 6,382,998 B2
DATED : May 7, 2002
INVENTOR(S) : Takeya Miwa

It is certified that error appears in the above-identified patent and that said Letters Patent is hereby corrected as shown below:

Column 10,
Line 11, "(S1)" should read -- S1 --.
Line 18, "(S2)" should read -- S2 --.
Lines 21 and 22, "(S2) is that the first displacement (S1)+the second displacement S2>0." should read -- S2 is that S1 + S2 > 0. --

Signed and Sealed this

Twenty-first Day of January, 2003

JAMES E. ROGAN
*Director of the United States Patent and Trademark Office*